US005122932A

United States Patent [19]

Ziller

[11] Patent Number: 5,122,932

[45] Date of Patent: Jun. 16, 1992

[54] ILLUMINATED ROTARY BOW SIGHT SYSTEM

[76] Inventor: Ronald C. Ziller, 1327 S. 21st St., Sheboygan, Wis. 53081

[21] Appl. No.: 747,969

[22] Filed: Aug. 21, 1991

[51] Int. Cl.[5] ..... F41G 1/467

[52] U.S. Cl. ..... 362/32; 362/109; 33/265; 124/87

[58] Field of Search ..... 362/157, 32, 109, 110, 362/253; 33/265, 241; 124/87

[56] References Cited

U.S. PATENT DOCUMENTS

| | | | |
|---|---|---|---|
| 3,945,127 | 3/1976 | Spencer | 33/265 |
| 4,166,324 | 9/1978 | Carollo et al. | 33/241 |
| 4,177,572 | 12/1979 | Hindes | 33/241 |
| 4,220,983 | 9/1980 | Schroeder | 362/110 |
| 4,325,190 | 4/1982 | Duerst | 33/265 |
| 4,521,972 | 6/1985 | Larson | 362/110 |
| 4,813,150 | 3/1989 | Colvin | 33/265 |
| 4,928,394 | 5/1990 | Sherman | 124/87 |
| 4,977,677 | 12/1990 | Troescher, Jr. | 124/87 |

*Primary Examiner*—Richard R. Cole
*Attorney, Agent, or Firm*—H. Jay Spiegel

[57] ABSTRACT

A bow sight system is disclosed which allows the user to choose any one of a plurality of ranges. Optical fibers are used to illuminate the sighting mechanism so that whichever sighting fiber is indexed to the use position will be illuminated for easy viewing by the user. The device is clamped onto a bow and includes an on-off switch which is activated when the user draws the bow with the other hand. The device is battery powered and may easily be removed from the bow.

8 Claims, 6 Drawing Sheets

ILLUMINATED ROTARY BOW SIGHT SYSTEM

BACKGROUND OF THE INVENTION

The present invention relates to an illuminated rotary bow sight system.

In the prior art, bow sighting systems are known, however, Applicant is unaware of any such system including all of the aspects and features of the present invention.

The following prior art is known to Applicant:

U.S. Pat. No. 4,884,347 to Larson discloses a bow sight having a plurality of pins designed to allow differing ranges. However, these pins are not mounted on a rotary barrel as is the case with the present invention nor does the Larson device have the activating means specifically disclosed herein.

U.S. Pat. No. 4,895,129 to Hedgpeth discloses a peep sight with peep turner for a bow which includes a hexagonal disk mounted on the bowstring at a position generally above a knocking point of the bowstring but below the peep sight mechanism. The present invention differs from the teachings of this patent as including a bow mounted sighting mechanism having a barrel with a plurality of sighting fibers thereon.

U.S. Pat. No. 4,961,265 to Roberts discloses a sight mounting device for archery bows which includes a gun sight-type viewing means. The present invention differs from the teachings of Roberts as including a rotatably mounted barrel and means for activating the illumination means thereof when the bow is gripped.

U.S. Pat. No. 4,984,373 to Forrest discloses an archery bow sight having a plurality of sighting pins which may be vertically adjusted. This differs from the teachings of the present invention since the present invention includes rotatably mounted sighting pins.

SUMMARY OF THE INVENTION

The present invention relates to an illuminated rotary bow sight system. The present invention includes the following interrelated objects, aspects and features:

(a) In a first aspect, the present invention includes a mounting bracket designed to allow mounting of the device to an existing archery bow. The mounting bracket is mounted on the bow by suitable fastening means such as screws, with the sight system being mounted onto the bracket.

(b) Also mounted on the bow is an on-off switch which is disclosed in three embodiments which are designed to allow an on-off switch to be attached to any known bow. Each embodiment of the on-off switch is activated by drawing the bow at a region thereon where the bow is normally gripped when it is actually in use. Drawing of the bow in such location causes closing of the switch to complete a circuit causing activation of the sight system.

(c) The sight system includes a barrel which may be indexed to any one of a plurality of positions corresponding to the number of sights mounted therein. Each sight may be connected to a light source via fiber optics with each sight comprising the end of an optical fiber, extending radially outwardly from the barrel housing.

(d) Illumination means in the form of a light bulb is activated responsive to compression of the on-off switch mounted on the bow. This light bulb shines light into the optical fiber which is indexed into aligned position thereover to cause light to be conveyed to the end of the optical fiber which extends radially outwardly from the barrel to provide an illuminated sight. The barrel may be indexed by moving it upwardly in a mounting bracket, thereafter rotating it to the desired indexed position and then allowing a compression spring to move the barrel downwardly to a locked indexed position.

(e) The inventive bow sight system is suitably powered by batteries to allow the user to operate the device and the associated bow free from electrical conductors.

As such, it is a first object of the present invention to provide an illuminated rotary bow sight system.

It is a further object of the present invention to provide such a device including a barrel which may be rotatably indexed to index one of a plurality of sighting fibers into a sighting position.

It is a further object of the present invention to provide such a device which is activated responsive to the user drawing the bow in a desired position thereon.

It is a yet further object of the present invention to provide such a device which may easily be mounted on and removed from an existing archery bow.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 3:
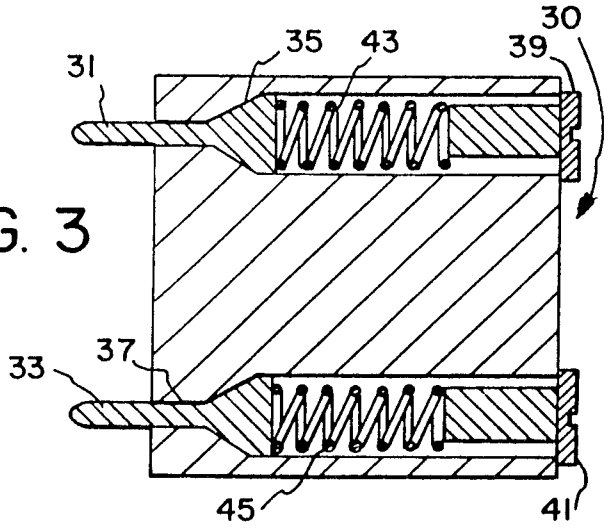
FIG. 3 shows a cross-sectional view along the line 3-3 of FIG. 1.
Figure 4:
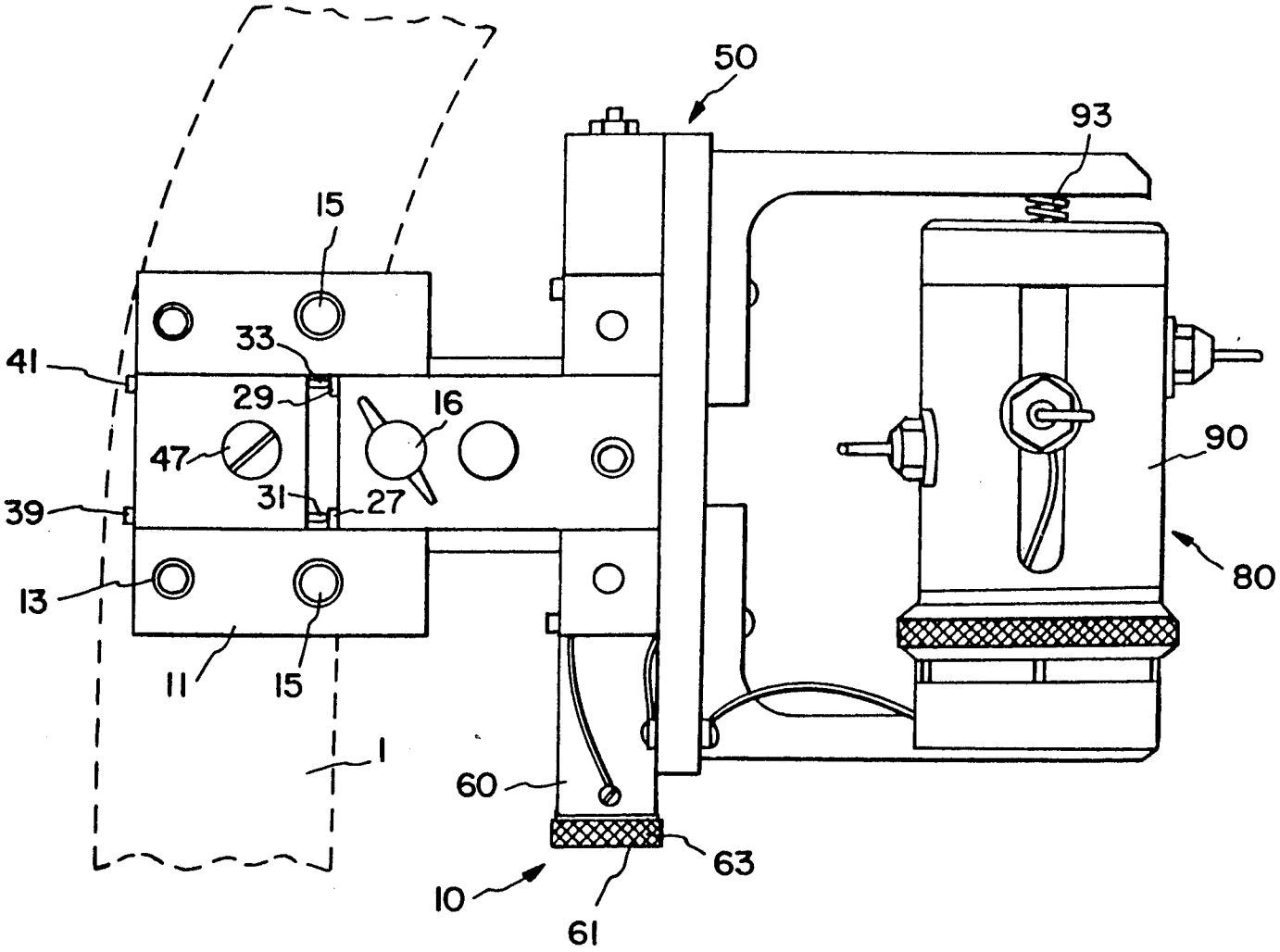
FIG. 4 shows a side view of the present invention as mounted on an archery bow.

With reference, first, to FIGS. 1-9, the present invention is generally designated by the reference numeral 10 and is seen to include a mounting bracket 11 having a plurality of holes 13 designed to receive screws 15 (FIG. 4) to allow detachable mounting of the bracket 11 to an archery bow 1 (FIG. 4). The mounting bracket 11 has a dovetail groove 17 therein to allow rigid attachment of the sighting device 20 thereto.

Figure 1:
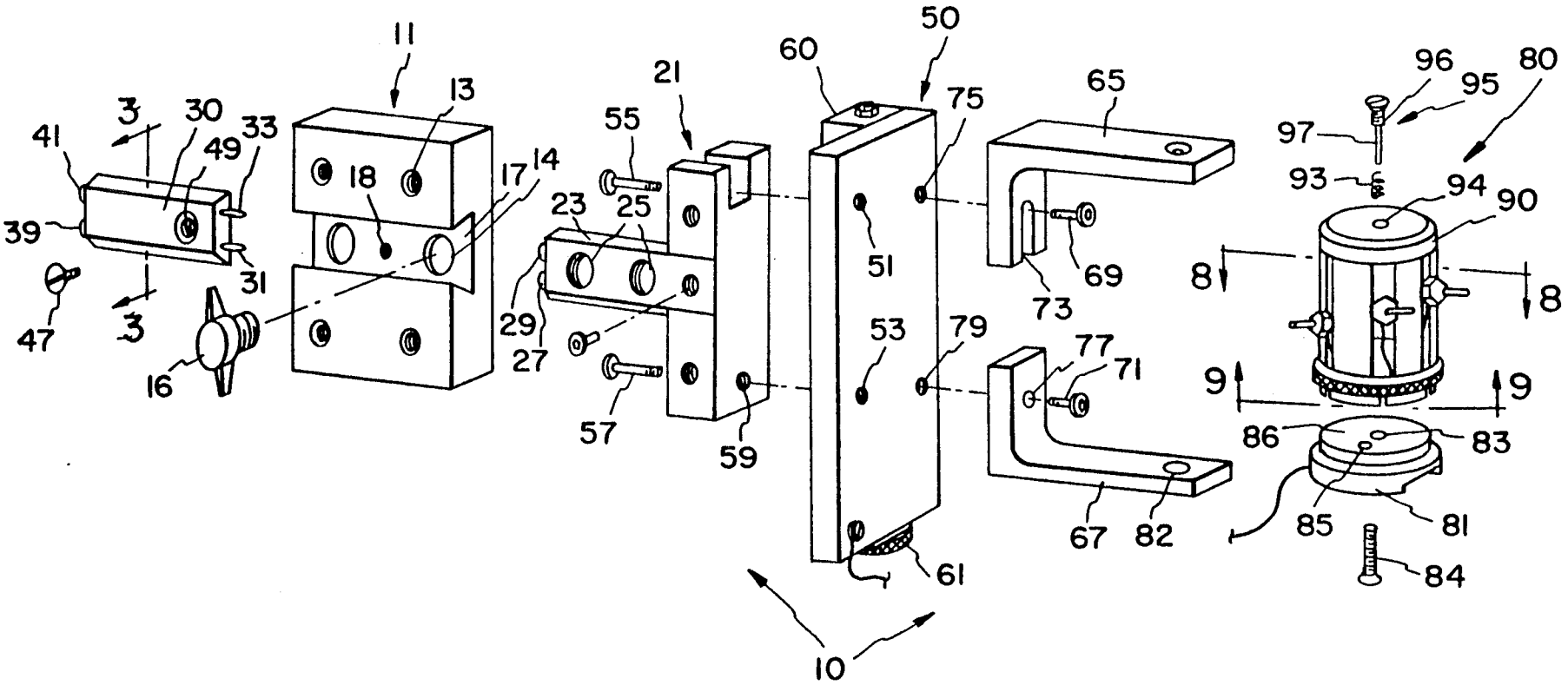
FIG. 1 shows an exploded perspective view of the present invention.
Figure 7:
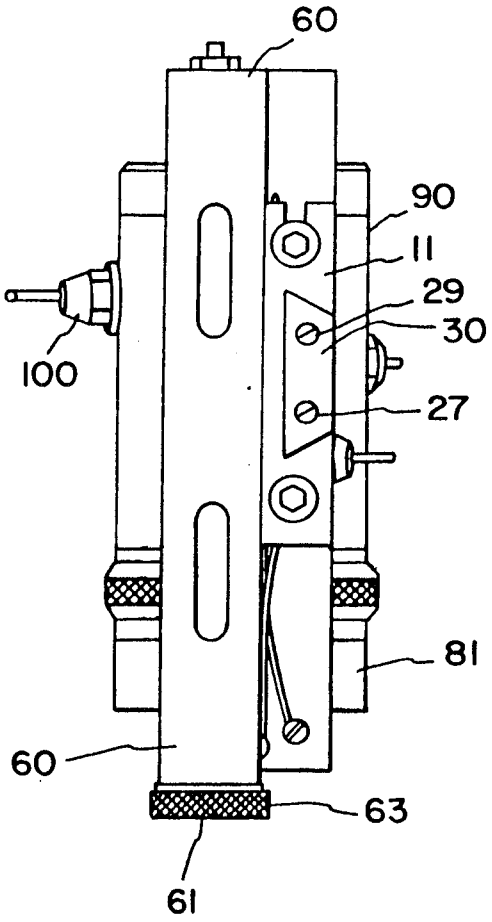
FIG. 7 shows an end view of the present invention.
Figure 5:
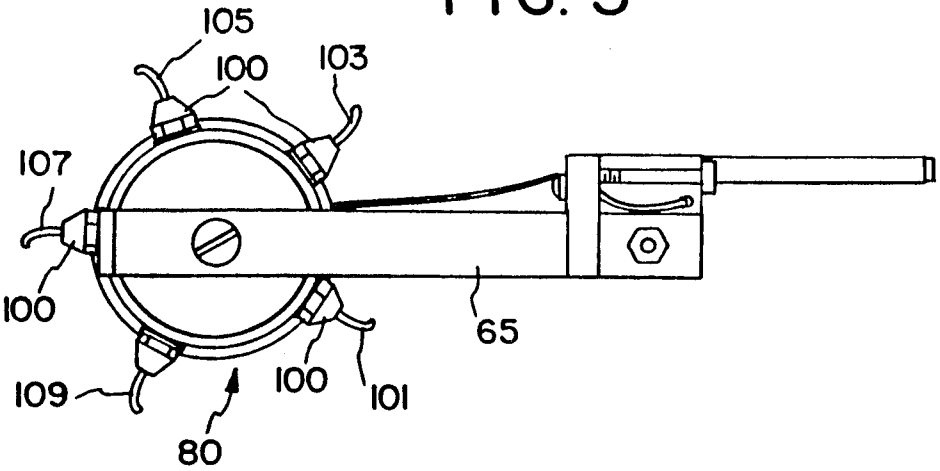
FIG. 5 shows a top view of a portion of the invention.
Figure 6:
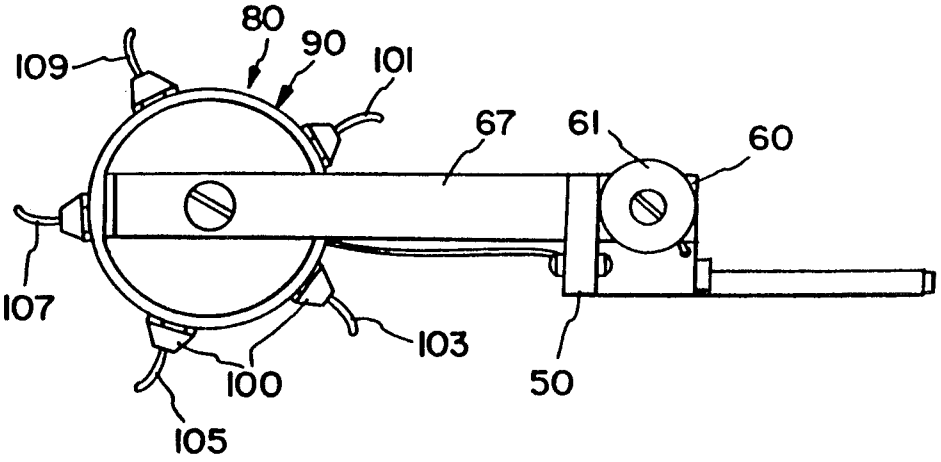
FIG. 6 shows a bottom view of the present invention.
Figure 8:
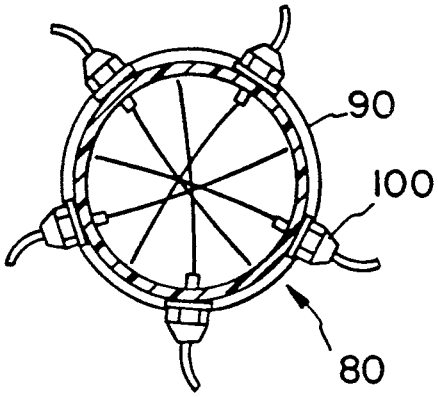
FIG. 8 shows a cross-sectional view along the line 8—8 of FIG. 1.

A T-shaped mounting device 21 includes a dovetail projection 23 (FIG. 1) designed to be slidably received within the dovetail groove 17 and having holes 25 therethrough which are threaded and alignable with the hole 14 in the mounting bracket 11 so that a threaded fastener 16 may be employed to fasten the T-shaped bracket 21 to the mounting bracket 15 in the manner particularly shown in FIG. 4. As seen in FIGS. 1, 4 and 7 in particular, the T-shaped bracket includes two contact screws 27, 29 provided for a purpose to be described in greater detail hereinafter.

With further reference to FIGS. 1, 3 and 4 in particular, an electrical connector 30 is seen to include two contact pins 31, 33 slidably received within respective recesses 35, 37 and connected to respective contact screws 39, 41 via respective electrically conductive springs 43, 45. As best seen in FIG. 1, the electrical connector 30 is of dovetail shaped configuration allowing it to be slidably received within the dovetail groove 17 of the mounting bracket 11. In the mounted position thereof, with the screw 47 threadably received within the threaded hole 49 and the threaded recess 18 of the bracket 11, the pins 31, 33 respectively engage the contact screws 27, 29 (FIG. 4) to provide electrical connection therebetween. The contact screws 39, 41 interconnect with the various embodiments of the on-off switch illustrated in FIGS. 10–15 as will be described in greater detail hereinafter.

With continuing reference to FIGS. 1–7, the inventive device 10 includes a housing 50 to which the T-shaped bracket 21 is mounted via threaded holes 51, 53 in the housing 50 and threaded fasteners 55, 57 extending through openings in the T-shaped bracket 21 of which the opening 59 for the fastener 57 and the opening 53 are particularly shown in FIG. 1.

Figure 2:
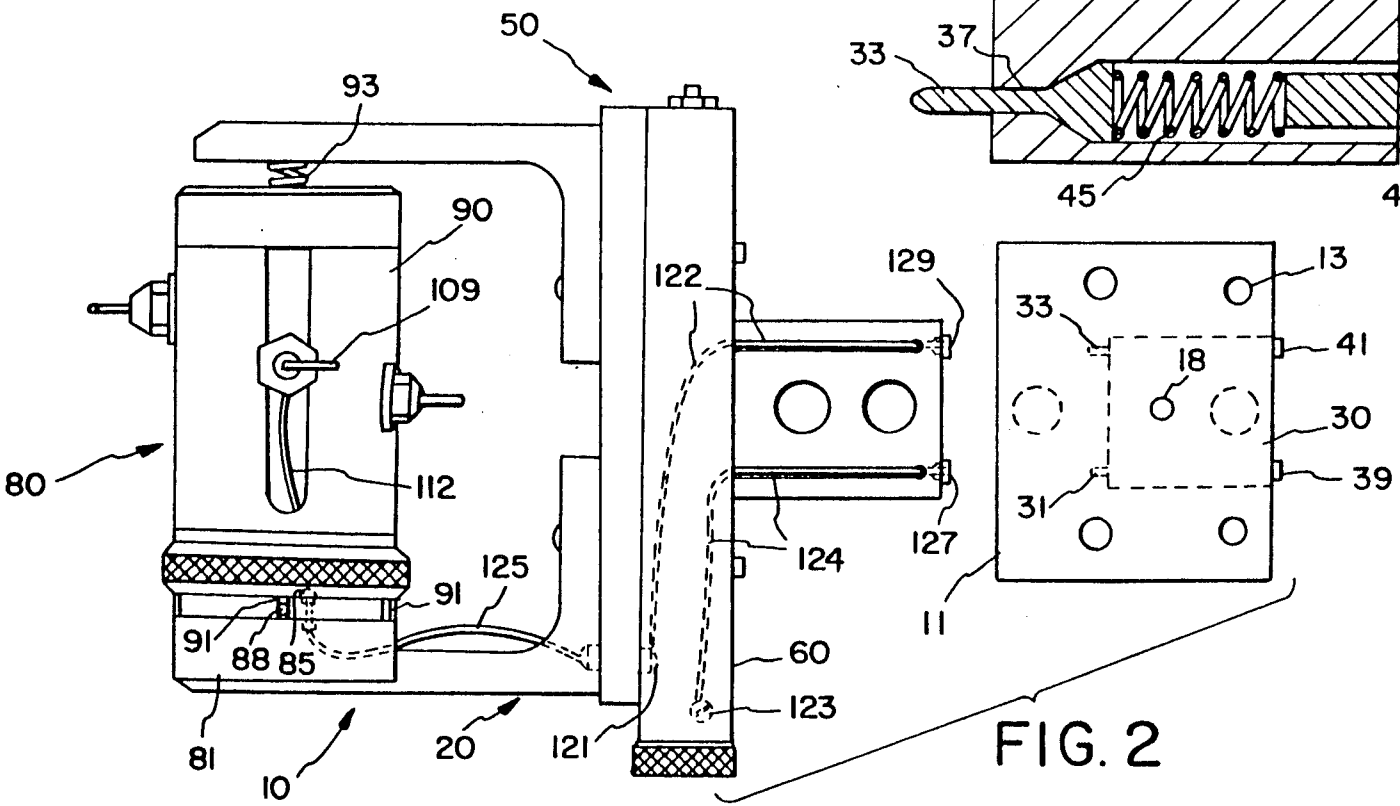
FIG. 2 shows a side view of the present invention in a position generally reversed from the position shown in FIG. 1 and with a portion thereof exploded to show detail.

With reference to FIGS. 2, 4 and 7 in particular, it is seen that a battery container 60 is suitably attached to the housing 50 and is intended to contain, for example, two batteries to provide power for the system. A threaded cover 61 having a knurled outer surface 63 is provided to close an opening allowing access to the interior of the battery chamber 60 to allow changing of dead batteries.

With further reference to FIGS. 1, 2 and 4, it is seen that two L-shaped brackets 65 and 67 are suitably mounted to the housing 50 by virtue of threaded fasteners 69, 71. The fastener 69 may extend through a slot 73 in the bracket 65 allowing lateral adjustment and thence into a threaded opening 75 in the housing 50. The threaded fastener 71 may extend through a hole 77 in the bracket 67 and thence into a threaded opening 79 in the housing 50.

The L-shaped brackets 65, 67 are provided to rotatably mount a sighting barrel generally designated by the reference numeral 80. The sighting barrel 80 is seen in FIGS. 1–9 and includes a fixed light base 81 mountable on the bracket 67 by virtue of an opening 82 in the bracket, a threaded hole 83 through the base 81 and a threaded fastener 84 extending through the hole 82 and threadably received within the hole 83. The base 84 has illumination means in the form of a light bulb 85 shining upwardly from an opening 86 in the base 81. Rotatably mounted on the base 81 is a barrel 90 which may be locked in any one of a multiplicity of rotative positions on the base 81 by virtue of slots 91 formed in the barrel 90 and a pin 88 (FIG. 2) on the base 81 with which the slots 91 may be indexed.

The barrel 90 may be slightly reciprocated between the brackets 65, 67 against the force of compression spring 93 which is maintained partially within the opening 94 in the barrel 90 by a threaded fastener 95 having a threaded portion 96 and an elongated depending stem 97 which extends through the spring 93 and into the opening 94. Thus, with reference to FIGS. 1, 2 and 4, it should be understood that the barrel 90 may be reciprocated upwardly in the view of these figures against the force of the spring 93 to release the pin 88 from a slot 91 whereupon the barrel 90 may be rotated to a desired indexed position at which it may be locked by interaction of one of the slots 91 with the fixed pin 88. The indexed positions of the barrel 90 correspond with positions of optical fiber sighting devices as will be described in greater detail hereinbelow.

With reference to FIGS. 5, 6, 8 and 9, five optical fiber sighting devices are provided as designated by the reference numerals 101, 103, 105, 107 and 109. Each of these fibers is extended from the barrel 90 a desired distance by virtue of a threaded coupling member 100 provided for each fiber which may tighten about a threaded ring which is split in a plurality of places and has a generally conical shape (not shown) such that when a respective threaded coupling member 100 is tightened toward the barrel 90, the result is that the underlying split ring will tighten down upon the optical fiber to fix its position. Upon loosening of the fastener 100, the optical fiber extending therethrough may be pulled out or pushed back into the barrel 90 to a desired distance whereupon the fastener 100 may be suitably tightened to fix the position thereof. Each sighting device represents a distinct range.

Now, it is believed appropriate to trace the electrical circuitry of the present invention to see the interconnections between the various components thereof. Thus, the terminals 39, 41 are electrically attached to any one of the various embodiments of the on-off switch as illustrated in FIGS. 10–15 as will be described in greater detail hereinbelow. With reference to FIGS. 2 and 3, it is seen that the screw 39 connects to the reciprocating contact 31 by virtue of the electrically conductive spring 43. Similarly, the conductive screw 41 is electrically connected to the contact 33 by the conductive spring 45. Turning to FIGS. 2 and 4, it is seen that the contact 33 electrically connects with the screw 29 while the contact 31 electrically connects with the screw 27. The screw 29 electrically connects with the terminal 121 in the battery housing 60 by virtue of electrical conductor 122. The screw 27 electrically connects with a further terminal 123 in the battery housing 60 via the electrical conductor 124. These terminals 121, 123 connect to the opposed poles of the batteries (not shown) to complete the circuit. An electrical conductor 125 electrically connects the terminal 121 to the light bulb 85 while the terminal 123 is connected to ground.

Figure 9:
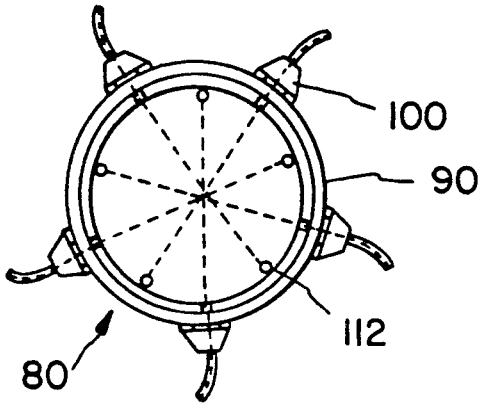
FIG. 9 shows a cross-sectional view along the line 9—9 of FIG. 1.

With particular to reference to FIGS. 2 and 9, it is seen that fiber 112 extends downwardly toward the light bulb 85. In the indexed position shown in FIG. 2, with the fiber 112 aligned with the bulb 85, when the circuit is closed by drawing on the bow handle as will be described in greater detail hereinafter, light from the bulb 85 will travel up the fiber 112 and into the sight pin to illuminate the fiber 112 to allow easy viewing by the archer, even in poor light. FIG. 9 shows the five ends of the optical fibers like that which is referred to by the reference numeral 112 in FIG. 2, as located adjacent the inner walls of the barrel 90 in equally spaced relation about the circumference thereof. As such, it should be understood that each indexed position of the barrel 90 with respect to the brackets 65, 67 will result in one optical fiber such as that which is designated by the reference numeral 112 being aligned with the light bulb 85 to thereby cause an optical circuit to be completed between the light bulb 85 and one of the sighting pins 101, 103, 105, 107 or 109 with the device being designed such that the particular fiber which is illuminated is also that fiber which is indexed into viewing position by the hunter as shown in the view of FIG. 7. Thus, in the position shown in FIG. 7, the optical fiber in view is optically connected to the light bulb 85 so that when the light bulb is illuminated, the fiber is also illuminated.

Now, with reference to FIGS. 10–15, the various embodiments of on-off switches of the present invention will now be explained.

Figure 10:
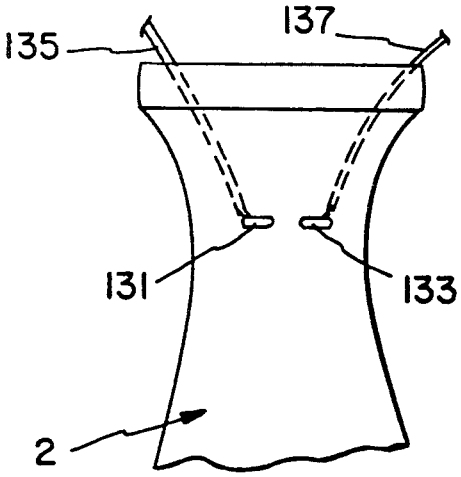
FIGS. 10 and 11 show front and side views, respectively, of a first embodiment of on-off switch of the present invention.
Figure 11:
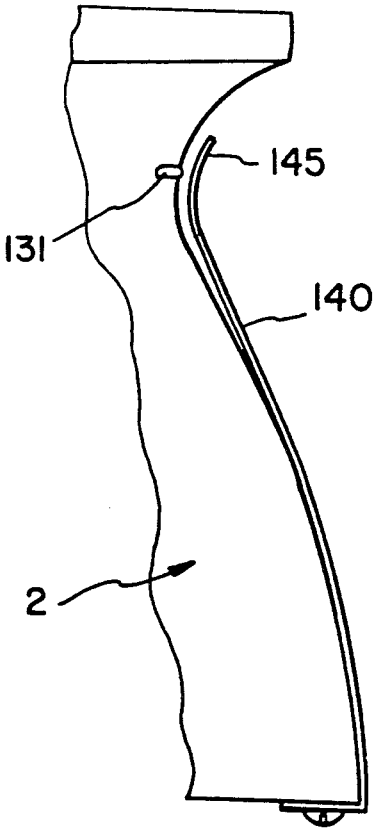

With reference to FIGS. 10 and 11, the bow is seen to include a gripping handle 2 to which contacts 131 and 133 are suitably attached, with these contacts being electrically connected to the terminals 39, 41 by virtue of the respective electrical conductors 135, 137. A brass contact plate 140 is suitably attached underneath the handle 2 by bent end 141 and a screw 143 received in a threaded opening in the handle 2 (not shown). As should be understood, when the handle 2 is gripped and the bow drawn by the archer, the top end 145 of the brass contact plate 140 will be squeezed into engagement with the contacts 131, 133 thus closing the circuit and causing illumination of the bulb 85.

Figure 12:
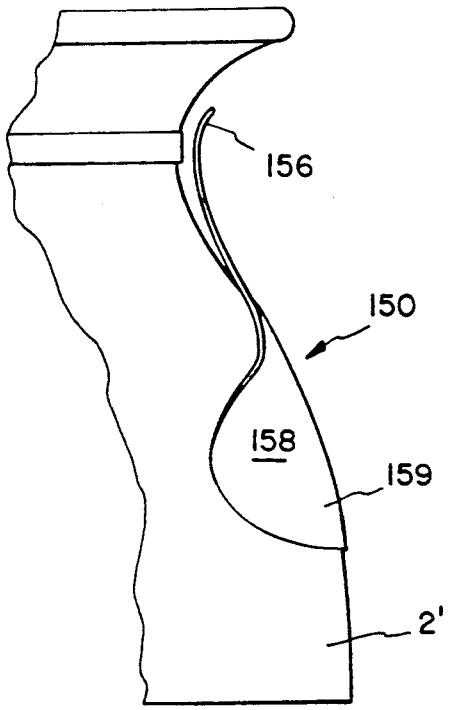
FIGS. 12 and 13 show side and front views, respectively, of a second embodiment of on-off switch of the present invention.
Figure 13:
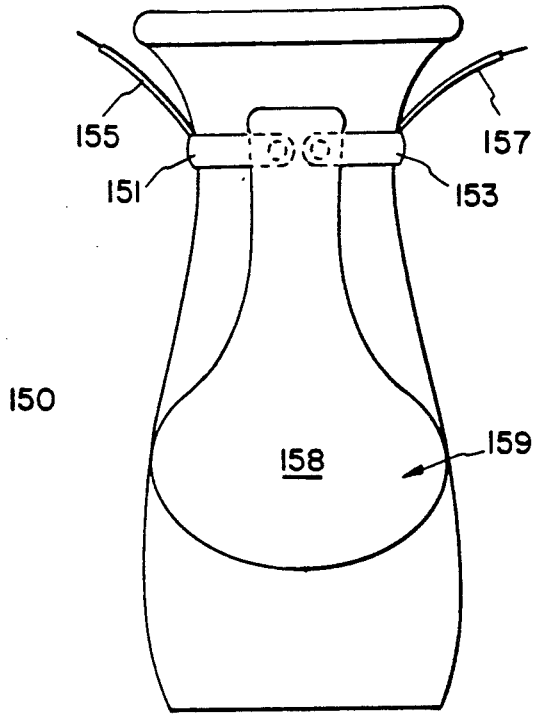

With reference to FIGS. 12 and 13, an on-off switch generally designated by the reference numeral 150 is provided in a situation where it is not desired to drill the gripping handle. Thus, contacts 151, 153 are suitably attached to the handle 2, by adhesive means such as adhesive or adhesive backed tape. The respective electrical conductors 155, 157 electrically connect the contacts 151, 153 with the contact screws 39, 41. The brass contact blade 159 is also attached to the handle 2, at the underside of the location designated by the reference numeral 158 by suitable means such as, for example, adhesive or adhesive backed tape. When the end 156 of the contact plate 159 is forced forward, the contacts 151, 153 are electrically connected to cause the light bulb 85 to illuminate.

Figure 14:
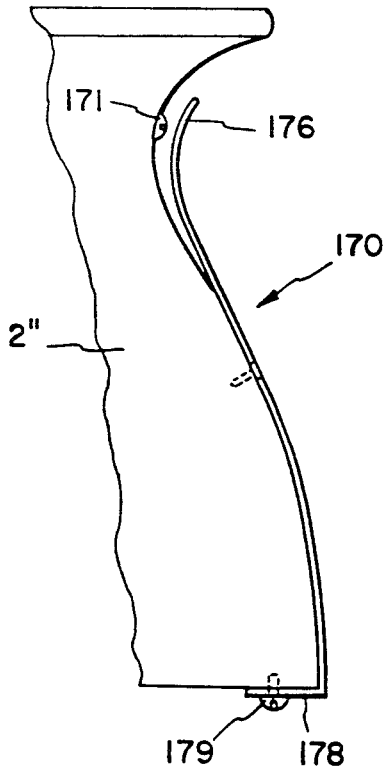
FIGS. 14 and 15 show side and front views, respectively, of a third embodiment of on-off switch of the present invention.
Figure 15:
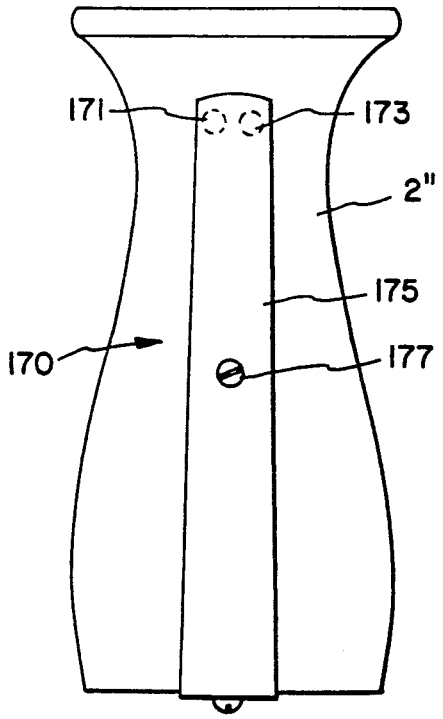

With reference to FIGS. 14 and 15, an on-off switch 170 is shown and is designed for a situation on a handle 2'' which may have a leather cover. The switch 170 includes contact screws 171 and 173 which are electrically connected to the respective contact screws 39, 41 by electrical conductors (not shown) in the same manner as is the case in the embodiments of FIGS. 10–11 and 12–13. A brass contact plate 175 is fastened to the handle 2'' by a screw 177, a bent portion 178 and a further screw 179. Again, when the portion 176 of the contact plate 175 is forced forward, a circuit is closed between the screws 171, 173 to close the circuit and cause the bulb 85 to illuminate.

In the operation of the present invention, in each embodiment of the switch as illustrated in FIGS. 10–15, each optical fiber 101, 103, 105, 107 and 109 is specifically located on the barrel 90 in a position relating to a particular range from the archer. Thus, for example, these ranges may comprise 10 yards, 20 yards, 30 yards, 40 yards and 50 yards from the archer. Thus, in the operation of the present invention, the archer must first choose the desired range and then may index the barrel 90 to the desired optical fiber by lifting the barrel 90 in the view of, for example, FIGS. 2 and 4 and rotating the barrel until the desired optical fiber is indexed into viewing position, whereupon the barrel 90 may be allowed to drop with the pin 88 on the base 81 indexing with the desired slot 91 to appropriately index the desired optical fiber into viewing position and the corresponding fiber into optical alignment with the light bulb 85.

In this position, the handle 2, 2' or 2'' is gripped and the bow drawn until the appropriate contacts are electrically interconnected as the switch 140, 150 or 170 is closed to cause the light bulb 85 to illuminate thereby illuminating the optical fiber corresponding to the fiber 112 illustrated in FIG. 2 and thereafter the exposed fiber corresponding to the optical fiber 112 illustrated in FIG. 2 to cause the appropriate sighting fiber which has been indexed into sighting position to be illuminated. With all of this having taken place, the archer may view the target with the illuminated sighting fiber and may release an arrow toward the target. When it is desired to change the range of the sighting mechanism, the above described steps are repeated until the desired optical fiber is indexed into the desired position.

Through use of the present invention, one may effectively choose a desired range, index a desired fiber into position and accurately shoot arrows at the target in an easy and sure manner. The various components of the present invention not included in the electrical circuitry thereof may be made of any suitable materials. Thus, for example, the various brackets may be made of aluminum while, for example, the barrel 90 may be made of plastic.

As such, an invention has been described in terms of preferred embodiments thereof which fulfill each and every one of the objects of the invention as described above and provide new and useful embodiments of an illuminated rotary bow sight system of great novelty and utility.

Of course, various changes, modifications and alterations in the teachings of the present invention may be contemplated by those skilled in the art without departing from the intended spirit and scope of the present invention.

As such, it is intended that the present invention only be limited by the terms of the appended claims.

I claim:

1. A bow sight system, comprising:

a) a bow bracket attachable to an archery bow;

b) a housing detachably attached to said bow bracket and including:

i) a battery chamber containing at least one battery;

ii) a barrel bracket; and iii) a rotatably adjustable sighting barrel mounted in said barrel bracket, said barrel carrying a plurality of optical fiber sights each protruding outwardly therefrom;

iv) said barrel having a fixed base with illumination means mounted therein with each optical fiber sight having a further fiber portion optically connected thereto and alignable with said illumination means in a particular rotative position of said barrel corresponding with an optically connected sight being indexed into a sighting position thereof; and c) an actuator switch electrically connected between said battery and illumination means, said switch being attachable on an archery bow whereby drawing of said bow closes said switch.

2. The invention of claim 1, wherein said bow bracket includes a first portion attachable to a bow and having a dovetail recess and a second portion attachable to said housing and having a dovetail projection receivable within said dovetail recess.

3. The invention of claim 1, wherein said battery chamber is positioned to contain two batteries and is closed by a threaded cap.

4. The invention of claim 1, wherein said plurality of optical fiber sights comprises five sights, each corresponding to a unique range.

5. The invention of claim 1, wherein said illumination means comprises a light bulb.

6. The invention of claim 1, wherein said switch is mounted on an archery bow with at least one screw.

7. The invention of claim 1, wherein said switch is mounted on an archery bow with adhesive.

8. The invention of claim 1, further including locking means for locking said barrel in any one of a plurality of particular rotative positions.

* * * * *